United States Patent [19]

Barry

[11] 3,939,775

[45] Feb. 24, 1976

[54] OVERHEAD TRANSFER CARRIER AND TRACKS

[76] Inventor: Leonard D. Barry, 19300 Pennington Drive, Detroit, Mich. 48221

[22] Filed: May 15, 1973

[21] Appl. No.: 360,527

[52] U.S. Cl. ..... 104/18; 104/88

[51] Int. Cl.[2] ..... B61K 1/00

[58] Field of Search ..... 104/18, 20, 122, 88, 89, 104/91, 123, 124, 172

[56] References Cited

UNITED STATES PATENTS

| | | | |
|---|---|---|---|
| 3,332,360 | 7/1967 | Leach | 104/22 |
| 3,484,002 | 12/1969 | Barry | 104/20 |
| 3,610,160 | 10/1971 | Alimanestianv | 104/76 |

*Primary Examiner*—Robert B. Reeves
*Assistant Examiner*—D. W. Keen

[57] ABSTRACT

This invention improves upon my Pat. Nos. 3,483,829 and 3,484,002 and on my pending patent application titled CONTAINER OVERHEAD TRANSFER AND STORAGE SYSTEM Ser. No. 269,239, filed July 5, 1972, wherein the improvement comprises a cam track dip and container carrier for operating thereon to vertically transfer loads to and from a moving train. The cam dip serves to lower and raise a hook or load frame on the carrier to transfer one or more containers or cages to and from a train running parallel below. The hook or load frame is secured on double parallelogram linkage to the frame of the carrier and has outboard wheels for running on the cam track for parallel level movement of the frame down and up along the transfer dip. The hook or load lifting frame is hooked or latched to the carrier frame when lifted thereto and released by bars on each side of the carrier when these bars engage wheels positioned at the dip to release the hook or load frame for a transfer dip when the carrier is checked for register of container with empty spot on car in train to which the carrier is vertically coupled. This cam dip is further applied to carriers having a transfer container or cage as part of the carrier. The hook frame has container hooks which take less space to operate and are enclosed when opened so as not to interfere with the cam track. Where the container is moved along conveyor in car and shifted on carrier in station a stationary hooking arrangement is provided.

12 Claims, 29 Drawing Figures

INVENTOR.

Leonard D. Barry

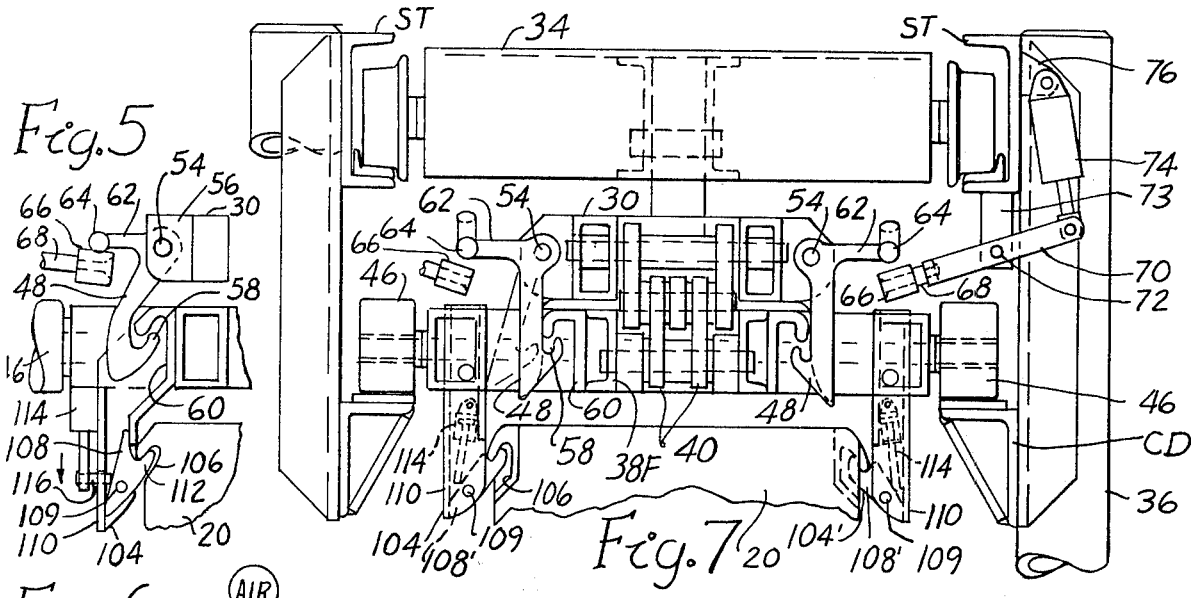
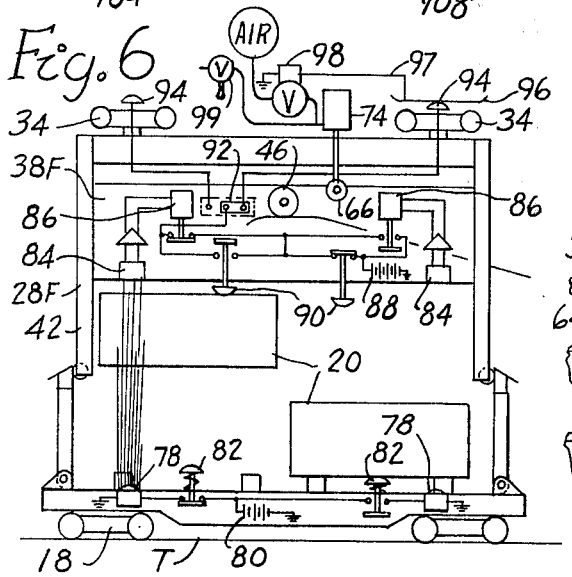
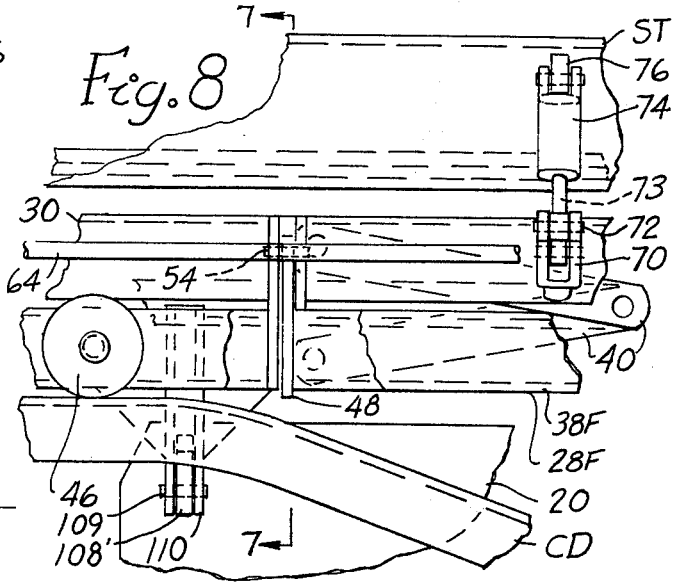
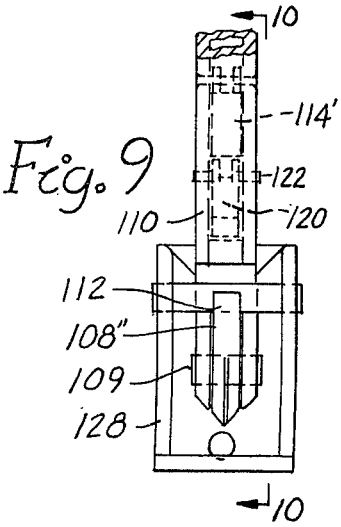
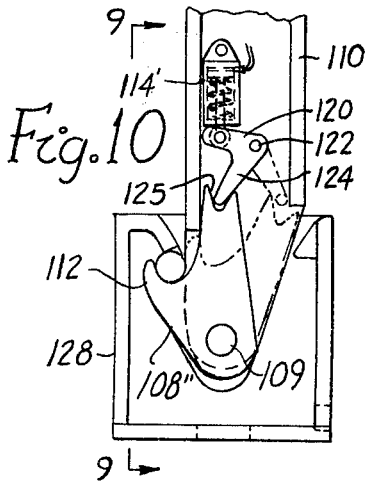
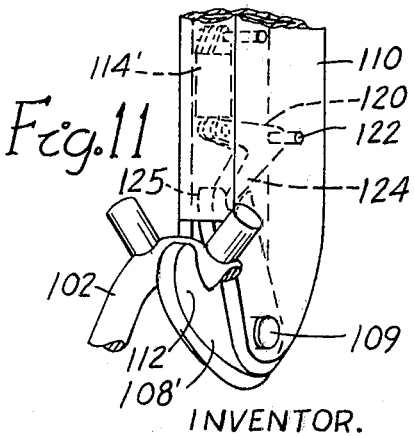
INVENTOR.
Leonard D. Bary AIR
INVENTOR.
Leonard D. Barry

INVENTOR.

Leonard D. Barry

OVERHEAD TRANSFER CARRIER AND TRACKS

An object of this invention is to simplify the transfer dip by eliminating the double dip tracks and switches (of my pending application cited) by providing a lifting or hook frame supported to move up and down parallel on and in alignment with the carrier frame and by providing a central wheel or pivoted wheel unit on the hook frame for supporting the hook frame on a cam track dip (replacing the double dip and switches) to lower and lift the containers on the carrier.

A further object is to latch the hook frame to the carrier frame and to release the hook frame just ahead of the dip for transfer only when transfer is desired and checked for register of container with empty spot, to eliminate the cam track except at the transfer dip and eliminate need for cam track switches and runby cam track over the dip.

As a further feature the carrier track rails are run beyond sides and just above top of railway cars to fit existing subways and underpass clearances. The carrier fits in between rails of this track and extends container down into railway car. The cam track lifts the container or cages up out of train to station stop while the train runs nonstop by the station. With such arrangement the passenger container or cage can stay with the carrier as part therof for transfer of persons to and from train while inserted in train between stations.

It is an object to simplify and improve the container hooks on the carrier to make these hooks more compact, to not cause sway of container, and to be most dependable of operation and simple for reduced cost and maintenance.

These and further objects and advantages should be apparent to those skilled in the art upon consideration of this invention with reference to the drawings wherein:

FIG. 5 is a sectional view of the carrier at hooks to larger scale.

FIG. 6 is a side elevation of carrier over car to show schematically the hook frame hook release controls.

FIG. 7 is a sectional view of a modified form of carrier construction to scale of FIG. 5.

FIG. 8 is a side elevation of portions of carrier and cam track of FIG. 5.

FIGS. 9 and 10 are respectively side and end views of the preferred container hook on carrier engaging in a container pocket.

FIG. 11 is an oblique view of the preferred container hook engaging a container bail.

Figures 20, 21, 22, 23, 24, 25, 26, 27, 28, 29:
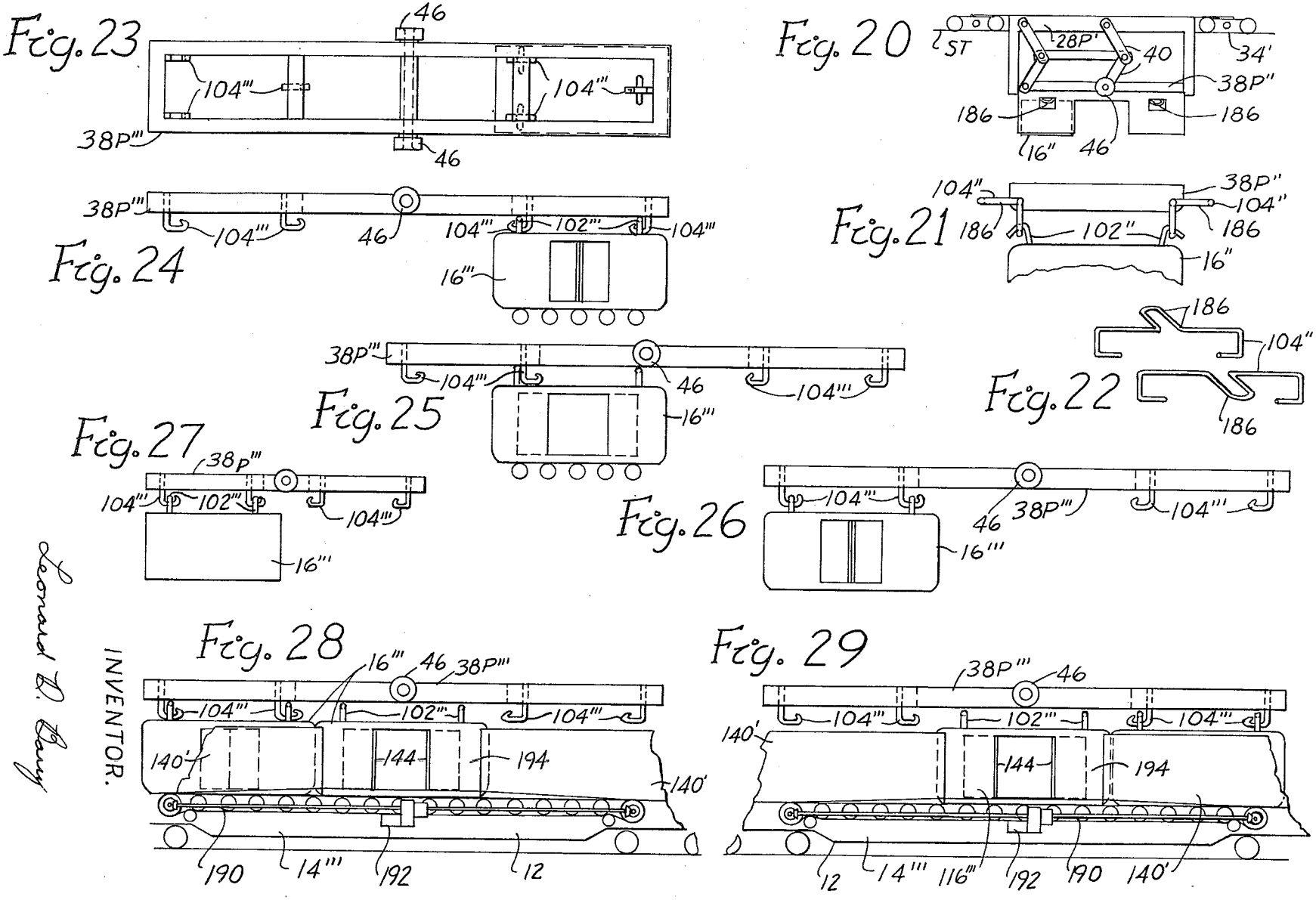
FIGS. 20 and 21 are side and crossectional views of a mass transit container carrier with cam dip controlled hook frame.
FIG. 22 is a perspective of a set of hooks for the hook frame of FIGS. 20 and 21.
FIG. 23 is a plan of another type of hook frame for carrier of FIGS. 20 and 21.

FIGS. 24, 25, and 26 are a series of side elevations of the hook frame of FIG. 23 to show how containers are unhooked, moved to right and rehooked on carrier in train or station.

FIG. 27 is a side elevation of hook frame of type as in FIGS. 23–29 except it is only two container lengths long.

FIGS. 28 and 29 are side elevations respectively showing the hook frame of FIGS. 23–26 depositing a container on a car and engaging a container after the containers are shifted before the forward container is lifted off the car.

Referring to the drawings and in particular to FIGS. 1–4, train 12, running in either direction on track T under transfer cam dip track CD under station track ST, includes passenger container transfer car 14 for passenger containers 16 and freight container cars 18 for cargo containers 20. Passenger and freight container carriers 28P and 28F run on station track ST centered over the railway track T and couple cars 16 and 18 respectively selectively for a transfer run across the dip as explained with FIG. 51 in my Pat. No. 3,483,829 and in my pending application mentioned, FIGS. 1–3 and 37–41.

Container carriers 28P and 28F each have a frame 30 supported at each end depending either from a trolley for I-beam track or from a swivel truck 34 which runs on wide gage channel rails of track ST run straight over cam dip track CD and supported on columns 36 transversely aligned and connected across top by tubular member 37. Track CD has preferably two rails of identical dip profile aligned and bracket supported off columns 36 along each side of track T. The carriers 28P and 28F have respectively hook frames 38P and 38F each connected by a double parallelogram linkage 40 to the frame of the carrier and guided by end coupling channels 42 to have vertical movement while held parallel and aligned with frame 30. Each hook frame has a short vertical shoe or channel 44 which fits over coupling channel 42 to guide thereon. Each hook frame has a cam wheel 46 central on each side to run on top of cam dip rail CD which curves up from each end for slight lift of the hook frames above hooked position so hooks 48 can be opened ahead of the dip and latched closed at end of the dip and curves down to slope to bottom curve to slope back up symetrical each side of bottom to lower and lift the hook frame level while the carrier frame passes straight along on track ST over the dip.

The vertical coupling channels 42 are mounted off center similarly one on each end of frame 30 for engaging between vertical latching couplers 50 or 52 on cars 16 or 18 respectively when these couplers are extended to latch these channels 42 of a carrier therebetween for moving the carrier along in register with the car in the train for transfer of one or more containers to and/or from the train. Couplers 50 and 52 preferably are as described and shown in my mentioned pending application, FIGS. 45–47 and 9–11 respectively, so as to recess to latch and to swing or move back to cushion coupling.

Carrier frame 30 has four hooks 48 along each side which are pivotally secured on pins 54, FIG. 5, between brackets 56 extending out from frame 30 so hooks 48 can swing transversely to latch under the hook frame when the hook frame is lifted nearly to the carrier frame. Each hook 48 has an inward facing and upturned tooth 58 which latches or engages in pockets 60 on the hook frame or optionally under the hook frame or under rails therealong. Hooks 48 each have a lever arm 62 extending outward from the pivot connected on each side of the carrier by a round bar or tube 64 turned up at ends and secured to the ends of the lever arms 62 along each side of the carrier to weight the hooks to close and to be lifted by engaging a wheel 66 ahead of the dip to release the hook frame for lowering on the dip while the carrier passes over the dip for transfer.

Figure 1:
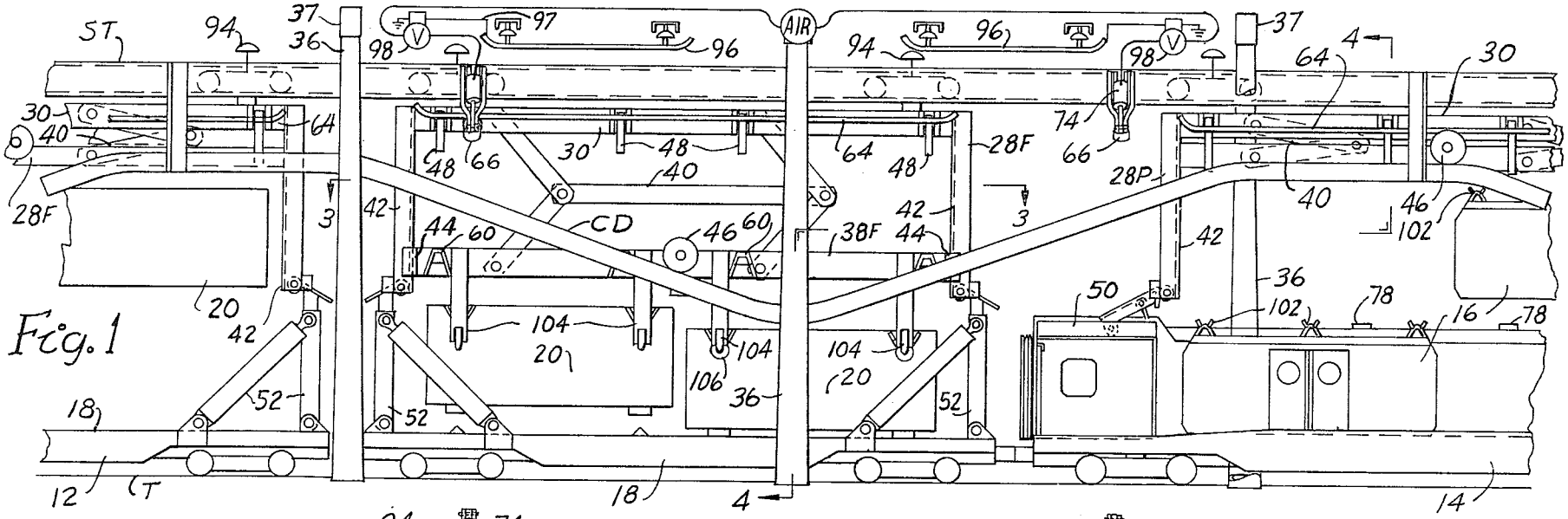
FIG. 1 is a side elevation of a portion of a train passing a transer dip.
Figure 2:
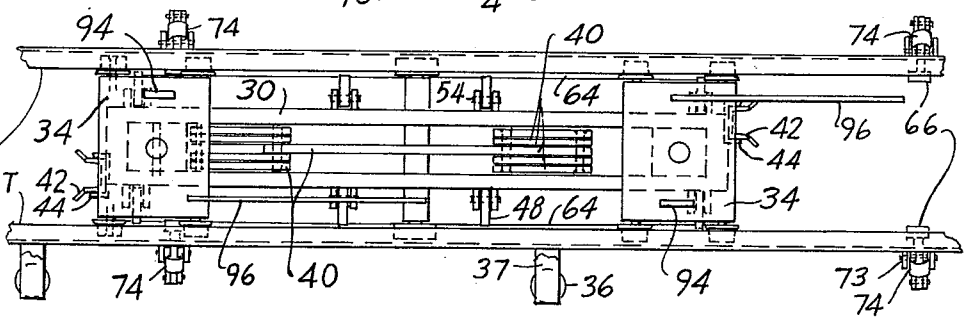
FIG. 2 is a plan view of a portion of FIG. 1.
Figure 3:
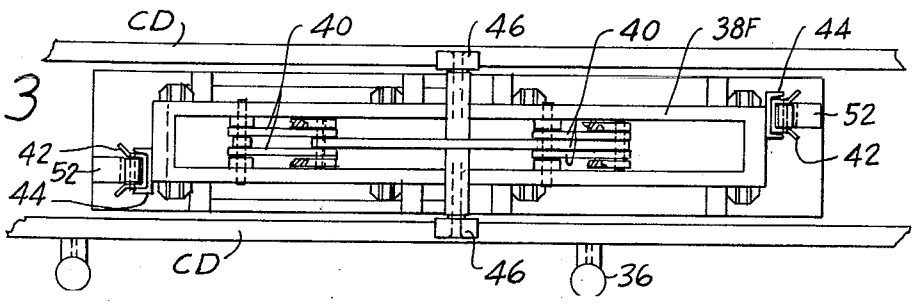
FIG. 3 is a sectional plan taken on line 3—3 of FIG. 1.

A wheel 66 is provided on each side of track ST, FIGS. 1–2, at each entrance to a cam dip CD to open hooks 48 while the hook frame is lifted by cam wheels 46 on the rise of track CD at ends of the dip. Wheels 66 are retractably mounted to frame of track ST and controlled to lift to open hooks 48 only when the carrier is coupled to a car in register for transfer. Wheel 66 is mounted on shaft 68 extending from bottom of U-shaped lever arm 70 pivoted near center on pin 72, FIG. 7, through bracket 73 extending down from rail of track ST. The opposite and outer end of lever arm 70 is pinned to rod end of cylinder 74 whose head end is pinned to bracket 76 extending out from outer face of channel rail ST.

Figures 12, 13, 14, 15, 16, 17, 18, 19:
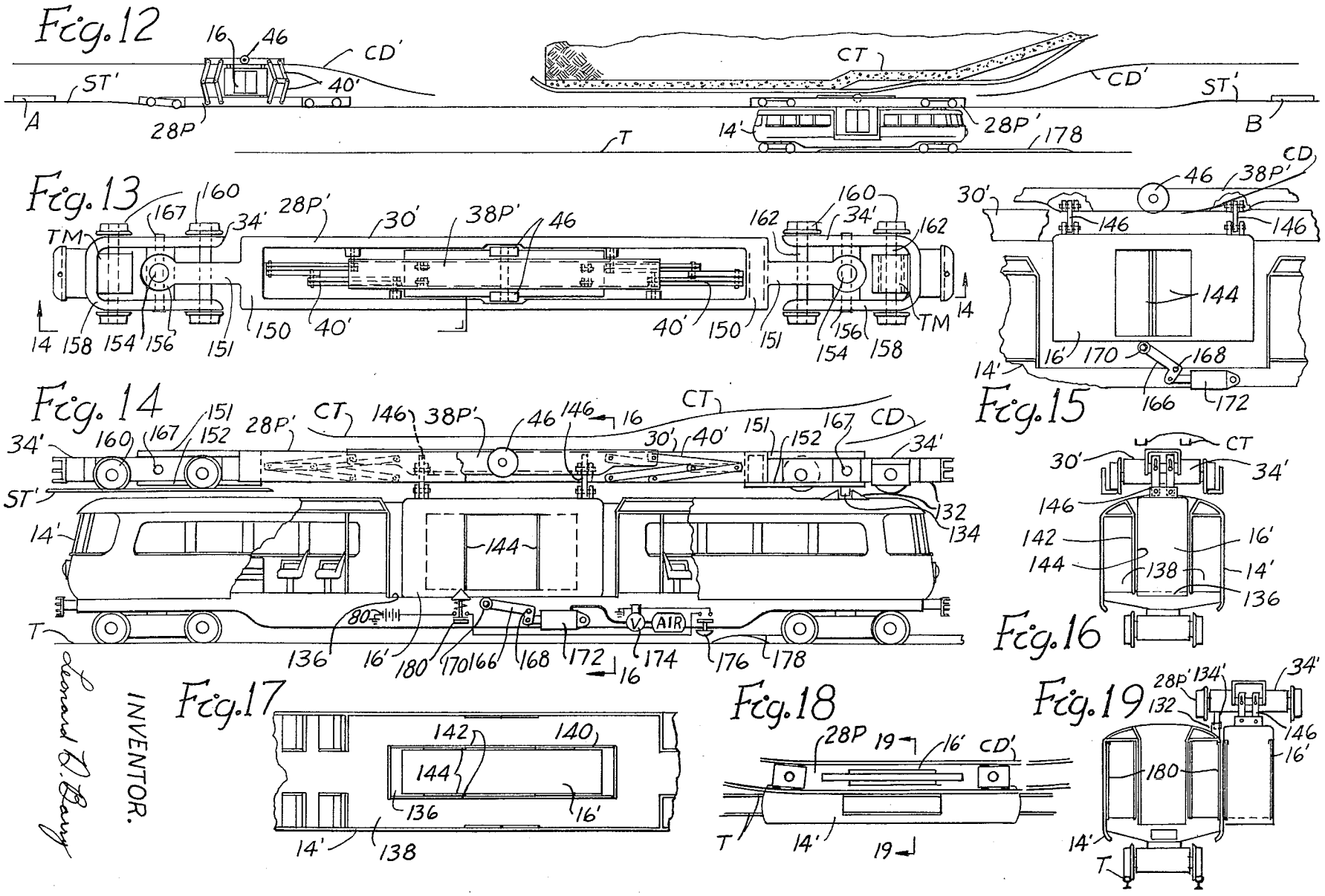
FIG. 12 is a side elevation of a transfer run between stations with cam track for inserting and removing carrier cages, one carrier being shown at station with cage lifted and another carrier shown with cage inserted in single car train running between stations under carrier track for transfer of persons from and to cage on carrier so train need not stop at stations.
FIGS. 13 and 14 are respectively plan of carrier and side elevation of carrier engaged in car.
FIG. 15 is a side elevation of center portion of FIG. 14 with container raised to position for removal by cam and cam track.
FIG. 16 is crossectional view on line 16—16 of FIG. 14.
FIG. 17 is a plan view of central portion of car of FIG. 14.
FIG. 18 is a plan view of the carrier of FIGS. 12–16 suspended from station track and coupled along side of the car.
FIG. 19 is a vertical section taken on lines 19—19 of FIG. 18 to larger scale.

Referring to FIG. 6, each car 18 has a lamp 78 for each container berth, lit by a circuit from positive of battery 80, normally closed contacts of limit switch 82 opened by container in berth, lamp 78 for that berth all in series to ground of battery 80. Lamp 78 is directed to shine vertically up to photoelectric cell 84 on hook frame of coupled carrier. Each cell 84 controls a relay 86 to close when light from lamp 78 is received. Relay 86 closes a circuit from positive of battery 88 on the hook frame, front contacts of relay 86 for each berth in series, each relay 86 having across its contacts a limit switch 90 opened by a container in that berth on the hook frame, directionally reversed switch 92 to shoe 94 located on right side of lead truck 34 to engage contact rail 96 after wheel 46 has lifted the hook frame so hooks 48 can be opened by wheels 66, line 97 to solenoid of valve 98, to ground of battery 88, to open valve 98 connecting air pressure supply AIR to cylinders 74 to lift wheels 66 to lift bars 64 to open hooks 48. Hooks 48 are held open by pressure in cylinder 74 after valve 98 closes and until a cam valve 99 connected to cylinders 74 is opened by shoe 94, which is on the far side of the rear truck 34 and disconnected at switch 92, when that shoe engages valve 99 when the hook frame is lowered to where hooks 48 can swing above the hook frame to position for latching the hook frame up when returned from the dip transfer. This control is substantially as shown in FIG. 17 of my stated pending application except therein dip switches are controlled instead of hooks which release a hook frame for the dip transfer. This control is also used for the passenger carriers 28P, lamps 78 being mounted on roof of car 14.

Figure 4:
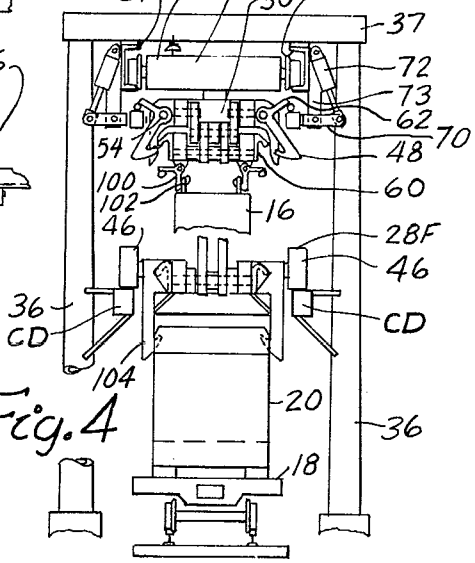
FIG. 4 is a sectional elevation taken on line 4—4 of FIG. 1.

Hook frame 38P is shown in FIG. 4 with hooks 100, smaller but similar to hooks 48, for engaging under bails 102 on top of container 16.

Hook frame 38F has hooks 104 for engaging in holes or pockets 106 in sides of containers 20. Hooks 104 are of special design to save space in handling the wide containers 20 and to not extend under rail CD which would cause interference. Hooks 104, FIG. 5, each comprise a hook plate 108 mounted on pin 109 near bottom between sides of a rectangular tube 110. Plate 108 is curved convex inward and up from below pivot pin 109 to tooth 112 above pin 109 to latch into hook pocket 106 on side of container 20. Hook plate 108 extends up behind the pocket of tooth 112 to engage the inner face of inner wall of tube 110 to support the tooth from swinging in beyond latched position. The hook is recessed into tube 110 when opened thus preventing catching on the pocket to insure release. The hook is opened by a hook opening cylinder 114 mounted rod down on back of tube 110 with finger 116 on end of rod extending through slot in tube 110 to engage back of plate 108 below pivot 109 to push down to rotate plate 108 into tube to open hook 104.

Hook 104 can have several variations, some being shown in FIGS. 7–11. Referring to FIG. 7, the bottom of hook plate 109' extends down below pin 109 to engage inner face of outer wall of tube 110 to support the hook in engaging position. The opening cylinder 114' with finger 116 omitted is pivotally mounted inside tube 110, FIGS. 7–11. In FIGS. 9–11 cylinder 114' operates a bell crank 120 pivoted on pin 122 between sides of tube 110 and having bottom arm 124 engaging in fork 125 on top of hook plate 108'' to swing the hook plate clockwise into shelter of tube 110 against outer wall. The bottom of tube 110 is tapered to shape of hook plate to guide the tube into hooking position. FIGS. 9 and 10 show the hook engaged in hook box 128 for top mounting on container. When the hook plate 108–108'' is opened it is fully recessed within the tube 110 and will then not catch on the box 128.

Cylinders 114'–114'' are either double acting or single acting spring retracted and are controlled for each container spot as cylinder 80 in FIG. 16 of my stated pending application. Hooks 100 are controlled for passenger containers according to FIGS. 43 and 48 of the same application. Various other hook arrangements can be substituted on the hook frames such as spacing for individual small container or for reaching under cargo containers or trailers supported on pedestals.

RAPID TRANSIT APPLICATION

On rapid transit systems the carriers preferably run station to station and so can stay with the train a considerable distance between stations. To reduce the clearance required for the carrier between stations and to economize on overhead structure or tunneling, the carrier track ST', FIG. 12, is run along with clearance just above top of sides of railway car 14' on track T. Track ST' is supported on columns 36 connected by spacing tubes 37 or can be mounted in subways including existing subways. Track ST is run at coupling height along the transfer run between stations. Track ST' is run at higher height over track T from where containers are lifted out of train to decelerate into station and through station to where carriers reach coupling speed. This rise in track ST' insures that the carrier is uncoupled and clears the train along the carrier's stopping and accelerating distance and while the carrier is at the station.

Cam track CD' over track ST' dips down after the accelerating and coupling run of carrier from station A and up before the uncoupling and decelerating run of carrier into station B etc. and is omitted for the dip run between stations wherealong the carrier 28P' rests cage 16' in car 14' until lifted out up cam track CD' to the next station.

Referring to FIGS. 12–17, passenger car 14' is self-propelled and running left to right on track T. Car 14' has a double latch coupling 132 as in my Pat. No. 3,483,829. FIGS. 55 and 56, mounted on roof as in FIG. 61 of that patent to engage a coupling pin 134 extending down from frame 30' of carrier 28P'. Car 14' has a container berth area 136 for one or more passenger containers or cages 16', an aisle 138 on each side of area 136 to seating at each end of car 14' separated from the berth area by partitions 140 with doors 142 which align doors 144 in cages 16' and are operated as in my stated pending application.

Carriers 28P' on track ST' are compact to adapt to existing subways without enlargement of the tunnel. Carrier 28P' has a wide frame 30' with open center for one or more containers or passenger cage 16' to pass through while supported depending from frame 38P'. Frame 38P' is a narrow tubular structure for suspending container 16' from depending tabs or links 146. Each end of frame 38P' is connected by a parallelogram linkage 40' to frame 30' beyond ends of container 16' on links 146 to maintain frame 38P' parallel to frame 30' as frame 38P' is moved up and down in and above the central hole in frame 30'. Parallel linkages 40' are beyond the ends of container 16' on frame 38P' in all positions of the linkage so the container can be lifted and lowered without interference from the linkages. Each parallelogram 40' recesses to within the opening in frame 30', FIG. 14. The sides of frame 30' are unconnected except at ends where tubular cross framing 150 provides strength for central arms 151 and 152, which extend endward at top and bottom of frame 38P' respectively. A roller 46 secured outboard on shaft extending from frame 38P' at midway its length on one or preferably both sides of frame 38P' engages cam track CD' to lift up the container or cage 16' to a station stop. Rollers 46 extend above frame 38P'. Frame 30' clears over track ST on curves.

A swivel truck 34' is pivotally connected on vertical pin 154 through trunnion block 156 between arms 151 and 152 at each end of frame 38P'. A trunnion pin 157 through block 156 pivotally mounts through holes in sides of frame of truck 34'. The sides of truck 34' are connected at outer end into U-shaped track frame 158, as seen in plan FIG. 13, which is supported on a usual spring arrangement for wheels 160 on ends of truck axles 162. A traction motor TM surrounds the end axle of each truck 34' and is secured to the frame 158 inside the truck. The frames and trucks of carrier 28P' fit substantially entirely between the channel rails of track ST or within the height of wheels 160 or trucks 34'.

Container 16' is shown suspended on four links 146 to frame 38P' as part of carrier 28P' and serves to hold frame 38P' longitudinally in line with frame 30' similarly as vertical coupling channels 42 depending from frame 30 at each end of the container or container area align frame 38F or 38P on frame 30, FIG. 1. Two links 146 are transversely spaced on each end of frame 38P' and pin mounted as a parallelogram to container 16' to transversely shift with car 14' as the carrier and car run along tracks ST and T. Links 146 are vertically slotted at the pin mounting hole at top to rest container on car 14' so variations between tracks T and ST and vertical springing movements between car 14' and carrier 28P' will not lift the container up in car while the car and carrier are running coupled between the dip and rise of the cam tracks CD'. If the container is suspended by hooks; vertical coupling channels 42 are added at each end of the container area depending from frame 30', and links 146 are made of tubes 110 each with a hook 104 on bottom to engage in bail on container 16 as in FIG. 1.

Cage 16' can be secured as part of frame 38P' if the run between stations takes sufficient time for passengers to leave containers on train and to enter the same containers for the next station. The cage 16' is closed before transfer. Partition doors 142 and cage doors 144 should be closed early enough for time to stop train before the container lift off if the doors are not closed. This therefore requires much longer run between stations than for transfer of containers. As alternative the container could be suspended from hooks 104 and released to the car when inserted and rehooked only if doors are closed or container is positioned safe for transfer out, to give train more stopping distance between stations if doors are not closed in time for transfer.

Cage 16' is lifted on car 14' to lift frame 38P' up to align wheels 46 to engage top of lift out rails of track CD' to remove the cage for the station. In a subway a ceiling track CT is run on ceiling to gage of track CD' against which wheels 46 are pushed to align to engage track CD' smoothly and to keep wheels 46 from hitting to rough low ceiling in the subway along where the containers are lifted to engage track CD'. A right-angle lever 166, pivotally secured at 168 to frame of car 14', has wheel 170 on end engaging bottom of cage 16' and is pin connected at other end to rod end of cylinder 172 pin mounted at head end to frame of car 14'. The head end of cylinder 172 is connected to air pressure supply AIR through pressure-exhaust solenoid valve 174. Valve 174 is controlled by circuit from positive of battery 80, cam switch 176 closed by trackway cam 178 extending back a ways from the lift-out, limit switches 180 closed by doors 144 to container when closed, solenoid of valve 174, all in series to ground of battery 80, to lift wheels 46 ahead of lift-out rails CD' to lift out container from the car when valve 174 is energized.

Carriers 28P' are decelerated after uncoupling from train and stop at station and are accelerated from station after a time delay set by approach of train car 14' using controls as in my Pat. 3,484,002, FIG. 31. The timer can be omitted with fixed train speed.

Referring to FIGS. 18 and 19, the carrier 28P' is shown on track CD' offset to one side of train car 14' to spot cage 16' along side at side doors 180 of car 14' which are opened for passage along the transfer run offset to side over track T. Vertical coupling latches 132 on left side at forward end of roof of car 14' engage therebetween a tab or roller pin 134' depending from right-hand side of forward truck 34' to couple carrier 28P′ along side of car 14′. Track CD curves slightly inward from each end of the transfer run to be closer to car 14′ after carrier is coupled until before the carrier is released so as not to rub against the carrier while at a speed difference with respect thereto. Carriers 28P′ can be sized for three to couple car –′ at a time each on a parallel track CD′, one each side of car 14′ and one centered above, for plural transfers to crossing or branch lines.

Referring to FIGS. 20–22, if there is not time for this type of transfer between stations the hook frame 38P″ is made long enough for two or more containers 16″ and have container hooks 104″ to release container 16″ when set into the car and engage another container 16″ for removal from the car, thus leaving a container on the car for extended time to unload and reload before removal by next carrier. Hook frame 38P″ has two sets of hooks 104″ one for each container 16″. Each hook 104″ is shown as being a bent bar having an outward faced central lever arm 186 and ends bent down and back longitudinally to latch under bails 102″ on the containers. Levers 186 at one end of frame 38P′ are lifted when the container thereon is set in car, and the hooks 104″ at opposite end of the frame engage a container to take it from the car. Bails 102″ are tapered from top transversely down to cam hooks 104″ open for latching thereunder. The lifting of levers 186 is preferably controlled on car as in FIG. 48 of my stated pending application.

Another variation of the hook frame and container hook eyes is shown in FIGS. 23–29 for use in passenger type service where the hook frame 38P‴ or shorter frame 38*p*‴, FIG. 27, is lowered for sufficient time for the container 16‴ to be indexed forward before the frame is lifted off. To provide time for the containers to be moved forward, the station track extends along bottom of the transfer dip a distance dependent on maximum train speed to allow time for containers to be moved forward by belt-over-roller conveyor 190 driven from either front end through clutches and gearmotor 192 while the hook frame is at bottom of travel to disengage the rear container and engage the forward container on the hooks on frame 38P‴ or 38*p*‴.

Frame 38P‴ has three hooks 104‴ at each end arranged, in plan view FIG. 23, in identical isosceles triangles similarly positioned but reversely bent at each end of the frame. Each hook 104‴ is a rod secured extending down from the frame to bend lengthwise the frame at a point in line with opening in transversely positioned bails 102‴ on containers 16‴ engage in the bails on the containers and turned up on the ends to prevent the containers from slipping off hooks 104‴ when lifted thereby. Containers 16‴ for engaging these hooks are carried forward by conveyor 190 while the carrier is engaged in car 14‴, the bails on these containers being turned crosswise and arranged in the isosceles triangular pattern to be engaged through by the three hooks 104‴ at either end of frame 38P‴ simultaneously. Frame 38P‴ is shown in the form of a rectangle to be connected in place of frame 38P to frame 30 above by double parallelogram linkage 40 as in FIG. 1.

When a container is set in car 14‴, FIG. 28, by frame 38P‴, hooks 104‴ are lowered further by dip of rail CD′ to clear the up-turned lip on hooks 104‴ for withdrawl of the bails 102‴ from the hooks as conveyor 190 moves the container forward. A container 16‴ just ahead of the one just inserted in the car is then moved forward, FIG. 29, onto forward hooks 104‴, stopping both containers with the newly inserted container at passage to aisles of car. The triangular arrangement of the hooks 104‴ enables the leaving and entering ends of container 16‴ to clear past these hooks. The hook frame is lifted after the containers have advanced forward to end of travel where the rear container is cleared from the hooks to be left on the car for unloading and reloading and the forward container is inserted on the hook fingers 104‴ at front to be lifted out. The conveyor moves the containers on the car one container length while the hook frame is inserted. The conveyor is controlled by limit switches as per FIG. 54 of my mentioned pending application, to start when container is inserted in car and to stop when the container inserted has cleared rear container spot ie. when forward container has entered hooks 104‴. Car 14‴ has partitions 140′ along aisles 138 on each side of the container area along which containers 16‴ are moved to and from an opening 194 in each partition 140′. Container 16‴ has doors 144 which align with opening 194. Doors 144 are controlled by any suitable means such as that disclosed in my stated pending application, FIGS. 50–54, except partition doors can be omitted. The conveyor is interlocked with these doors as in FIG. 54 of that application so containers are moved by the conveyor only when these doors are closed. Doors are opened similarly at station when container is held at platform. If shielding is added to the hook frame, doors 144 can be omitted, as taught by that patent application.

The container 16‴ brought into the station from train 12 is lifted off hooks 104‴ by a roller platform as in FIGS. 71 and 72 of my stated pending application and held by a stop at each end while the carrier moves forward to relocate the container at the rear while people leave and board the container for the next train into which the container is inserted along a transfer run between that station and the next.

Hook frame 38P‴ works in either direction of travel but cars and carriers with containers are turned in the same direction on the tracks for the containers to hook at both ends, since both ends of the container 16‴ and hook frame 38P‴ are of nonsymetrical arrangement. The hook frames 38F, 38F′ 38P, 38P′ and 38P″ and the containers therefore have similar ends to work either end forward.

These embodiments of the container transfer system are directed to simplifications well suited for miniature models and useable as toys which it is an object of this patent to cover.

Having thus described a few of the possible embodiments of this invention it should be understood that I do not wish to be limited to the embodiments described but contemplate to cover in the appended claims all variations and parts which fall within the true spirit and scope of this improvement invention.

I claim as my invention:

1. In a container transfer system comprising a track, thereon having at least one container vehicle, a station track run above the track substantially parallel therewith for a distance, at least one container, a container carrier on said station track for loading and unloading said container onto said vehicle while moving therewith, said carrier having a first frame and a second frame, wheel means supporting said first frame on said station track, said second frame being a container lifting frame, guide means on said carrier for guiding said lifting frame parallel and in alignment with said first frame, the improvement being at least one cam wheel on said lifting frame, a cam track comprising at least one rail on which said cam wheel runs along side of and above the first said track and including a dip down and up for lowering and raising said lifting frame to set down and pick up said container from said vehicle.

2. A system as in claim 1, hooks spaced along said first frame for engaging under said lifting frame to support same and means for opening said hooks together when said carrier is at head of the dip to release said lifting frame to make the dip, said hooks latching said lifting frame up under said first frame upon return from the transfer dip.

3. A system as in claim 1, said lifting frame having hooks thereabout for engaging said container, said hooks each comprising a depending tubular member, a hook plate pivotally secured at bottom in each said tubular member to swing in transverse plane and having a tooth above and inward from the pivot of the hook, means biasing said tooth inward to latching position, an extension of said hook plate for engaging said tubular member to stop inward movement at substantially latching position and means for swinging said hook plate into the enclosure of said tubular member when releived of the container.

4. In a system as in claim 1, said cam track being under said station track but above first said track.

5. In a system as in claim 1, said cam track being above said station track, said station track being wide gage suspended track.

6. In a system as in claim 1, said station track being to side of said track to bring said container on said carrier along side said vehicle.

7. In a system as in claim 1, locating means to hold said container in fixed position on said vehicle, linkage means suspending said container from said carrier so as to be lifted therein when set on said locating means on said vehicle and transversely move with said vehicle yet remain connected or attached to said carrier but take vertical and transverse misalignments between said vehicle and carrier with said container firm on said vehicle.

8. A system as in claim 1, said container being a cage suspended from said carrier so as to transversely and vertically move thereon to rest firm in said vehicle, said station track being wide gage having rails just above and one on each side of said vehicle.

9. A station vehicle and trackway therefore including a cam track for container transfer substantially as described.

10. A system as in claim 1 the first said track being a railway track, a train thereon, said vehicle being a car in said train.

11. A system as in claim 1, said guide means being a double parallelogram linkage connecting said first frame to said second frame for parallel vertical movement and guide members depending from said first frame one at each end interfitting with said second frame for guiding in line with said first frame.

12. In a system as in claim 11, said members being channels turned legs endward and extending down to couple said vehicle, and latching coupling means on said vehicle for engaging in said channels therebetween so said carrier and vehicle are held in alignment during transfer.

* * * * *